US006604533B2

(12) United States Patent
Hardenbrook et al.

(10) Patent No.: US 6,604,533 B2
(45) Date of Patent: Aug. 12, 2003

(54) HAIR WAVING APPARATUS

(75) Inventors: Wendy A. Hardenbrook, Salem, MA (US); Wesley J. Ishida, Peabody, MA (US); Brian Anderson, Norwood, MA (US); Ken Doucette, Norton, MA (US); John Walsh, Norfolk, MA (US)

(73) Assignee: Wendy Innovations, LLC, Peabody, MA (US)

( * ) Notice: Subject to any disclaimer, the term of this patent is extended or adjusted under 35 U.S.C. 154(b) by 0 days.

(21) Appl. No.: 10/079,724

(22) Filed: Feb. 21, 2002

(65) Prior Publication Data

US 2002/0195118 A1 Dec. 26, 2002

Related U.S. Application Data

(63) Continuation of application No. 09/888,161, filed on Jun. 22, 2001, now abandoned.

(51) Int. Cl.[7] ..... A45D 2/42
(52) U.S. Cl. ..... 132/225
(58) Field of Search ..... 132/225, 234, 132/226, 224, 245, 249, 259, 260

(56) References Cited

U.S. PATENT DOCUMENTS

| | | | |
|---|---|---|---|
| 38,010 | A | 3/1863 | Adams |
| 236,522 | A | 1/1881 | Wilson |
| 271,052 | A | 1/1883 | Fishwick |
| 278,944 | A | 6/1883 | Hauce |
| 1,380,064 | A | 5/1921 | Hoffman |
| 1,570,141 | A | 1/1926 | Glantz |
| 1,591,207 | A | 7/1926 | Berthelsen |
| 1,611,580 | A | 12/1926 | Chamberlain |
| 1,682,455 | A | 8/1928 | Wilson |
| D145,893 | S | 11/1946 | Graham |
| 2,776,667 | A | 1/1957 | Fitz Gerald |
| 3,680,565 | A | 8/1972 | Giles et al. |
| 4,739,151 | A | 4/1988 | Smal |
| 4,739,776 | A | 4/1988 | Pritjic |
| 5,119,846 | A | 6/1992 | Tadrous et al. |
| 5,934,293 | A | 8/1999 | Kaizuka |

*Primary Examiner*—John J. Wilson
*Assistant Examiner*—Robyn Kieu Doan
(74) *Attorney, Agent, or Firm*—Akin Gump Strauss Hauer & Feld LLP

(57) ABSTRACT

A hair waving apparatus having at least two elements with undulations on each element for producing a wave in a lock of human hair is disclosed. The elements are pivotally connected and are biased toward each other and the elements are maintained in engagement with each other by a biasing means in the form of a spring to hold the lock of hair therebetween to impart a wave thereon. The undulations are dimensioned to allow each of the elements to nest within each other. A plurality of vents are disposed thereon the undulations to allow moisture to escape from the hair during hair styling and to hasten the hair drying process and subsequent wave formation in the hair. Additional features of the instant invention include retaining means in the form of a stop are disposed on each of the elements for maintaining each of the elements in engagement with each other and the stop cooperatively interacting with the spring to hold the lock of hair therebetween to impart a wave thereon; and a tab is disposed thereon each of the elements for disengaging the elements from each other when the elements are biased away from each other and the hair waving apparatus is in an open position. Guide means, such as a pin, disposed on each of the elements in alignment with a hole therein the elements and the pin cooperatively interacting with the hole and with the spring for positioning the undulations of the elements in close proximity to each other.

17 Claims, 3 Drawing Sheets

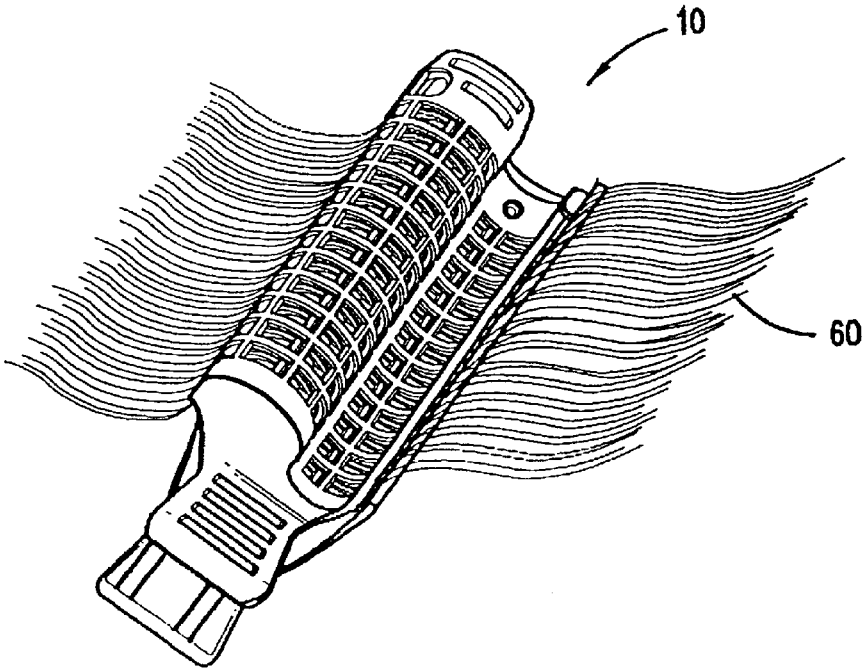
FIG. 7
FIG. 8
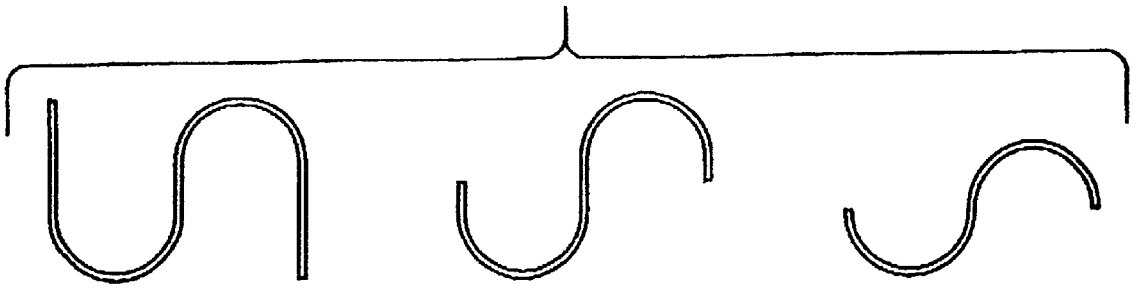
FIG. 8A
FIG. 8B
FIG. 8C
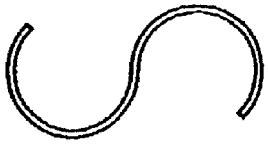
FIG. 8D
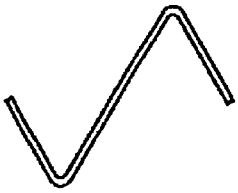
FIG. 8E

HAIR WAVING APPARATUS

CROSS-REFERENCE TO RELATED APPLICATIONS

This application is a continuation of U.S. application Ser. No. 09/888,161, filed Jun. 22, 2001, now abandoned.

FIELD OF THE INVENTION

This invention relates generally to hair waving. More particularly, the present invention relates to a hair waving apparatus for imparting a wave to hair for cosmetic purposes.

BACKGROUND OF THE INVENTION

Various hair styling devices are in use. The typical hair curler is a plastic cylinder around which the hair is wound about when wet. Clips and other means are provided for keeping the hair in place about the cylinder until it dries after which a curl is formed. Heat or chemical agents may be applied to the hair to enhance the curl. Another type of hair curler is an electric wand-type curling iron.

To impart a wave into hair, instead of curls, several devices have been disclosed in the prior art.

A problem with such hair waving devices is that some are complicated and awkward to use. Also, the hair wave resulting from those inadequate devices is uneven and is not aesthetically pleasing. Another problem is that the devices are expensive and electric waving apparatus are dangerous to use particularly with small children in the household.

A practical hair waving apparatus, for which there is an unfulfilled need, wherein the hair waving apparatus being capable of safely imparting a uniform and stylish wave in hair, is not available.

U.S. Pat. No. 5,119,846 to Tadrous et al, shows hair wave rollers which snap together to define a sinuous or swirled path therebetween. A disadvantage of this patent is that each separate hair roller can be lost causing user frustration and thereby making the device inoperable. Furthermore, no provision for or recognition of the need for combining the two rollers so that they can be more conveniently used is addressed, thereby making the design inconvenient to use.

U.S. Pat. No. 4,739,776 to Prijic discloses a hair curling apparatus with a modular tray with individual clamp rods pivoted on the sides of the tray for crimping the hair therebetween. A problem with Prijic's apparatus is that the tray is bulky and restrictive which makes it cumbersome to use as well as making it impractical for use particularly for independent hair waving. Furthermore, the use of a tray and rod system adds to the cost of the design.

U.S. Pat. No. 1,570,141 to Glantz discloses a clamp-like hair waver which is bulky, cumbersome and impractical to use and is costly to manufacture.

None of the above prior art devices disclose a hair waving apparatus which is practical, simple in design and is easy to use.

In view of the above mentioned problems and limitations associated with conventional hair waving and curlers, it was recognized by the present inventors that there is an unfulfilled need for an improved hair waving apparatus which is simple in design, practical, fun to use and is economically manufactured and which overcomes the disadvantages of the prior art devices.

SUMMARY OF THE INVENTION

It is therefore an object of this invention to provide a new and improved hair waving apparatus which avoids the aforementioned problems of prior art devices.

It is an object of the instant invention to provide a hair waving apparatus which may be manufactured from readily available materials by conventional manufacturing processes.

It is another object of the instant invention to provide a hair waving apparatus with undulations thereon that are readily adaptable at manufacture for use for a wide variety of hair wave styles.

It is a further object of this invention to provide a hair waving apparatus that is simple in design, simple to manufacture, low in cost and fun to use.

Further objects will become apparent from the following description and claims.

This invention results from the realization that there is a great need for an improved hair waving apparatus. The resulting invention provides a user the capability of conveniently being able to safely and effectively style hair without the problems associated with the prior art devices.

The above and the other objects are achieved in accordance with the present invention, which, according to a first aspect, provides a hair waving apparatus which has at least two elements with undulations on each element for producing a wave in a lock of human hair. The elements having means for pivotally connecting the elements together with a rod and biased toward each other with a biasing means in the form of a spring and the elements maintained in engagement with each other by the spring to hold the lock of hair therebetween to impart a wave thereon. The elements each have a shoulder extending from the undulations and a handle extending therefrom the shoulder at the pivotal connection to open the undulations for insertion of the lock of hair therebetween. The undulations of each of the elements are fabricated from a shape chosen from the group consisting of a "J" shape, a "U" shape, a "C" shape, an "S" shape and a "V" shape. The undulations are dimensioned to allow each of the elements to nest within each other. A plurality of vents are disposed thereon the undulations to allow moisture to escape from the hair during hair styling and to hasten the hair drying process and subsequent wave formation in the hair.

The second aspect is a special case of the first aspect of this invention with additional features. Retaining means in the form of a stop are disposed on each of the elements for maintaining each of the elements in engagement with each other and the stop cooperatively interacting with the spring to hold the lock of hair therebetween to impart a wave thereon; and a tab is disposed thereon each of the elements for disengaging the elements from each other when the elements are biased away from each other and the hair waving apparatus is in an open position. Guide means, such as a pin, disposed on each of the elements in alignment with each of the elements having a hole therein and the pin cooperatively interacting with the hole and with the spring for positioning the undulations of the elements in close proximity to each other.

BRIEF DESCRIPTION OF THE DRAWINGS

In the accompanying drawings:

FIG. 7 is a perspective view of the hair waving apparatus of FIG. 2 showing the instant invention of FIG. 2 in use with a lock of human hair, shown in phantom.

FIG. 8, including FIG. 8A, FIG. 8B, FIG. 8C, FIG. 8D and FIG. 8E, illustrates a representation of various shapes from which the undulations of the instant invention may be fabricated.

FIG. 8A is a front profile view, of an undulation of the instant invention in a "J" shape.

FIG. 8B is a front profile view, of an undulation of the instant invention in a "U" shape.

FIG. 8C is a front profile view, of an undulation of the instant invention in a "C" shape.

FIG. 8D is a front profile view, of an undulation of the instant invention in an "S" shape.

FIG. 8E is a front profile view, of an undulation of the instant invention in a "V" shape.

DETAILED DESCRIPTION OF PREFERRED EMBODIMENTS

Figure 1:
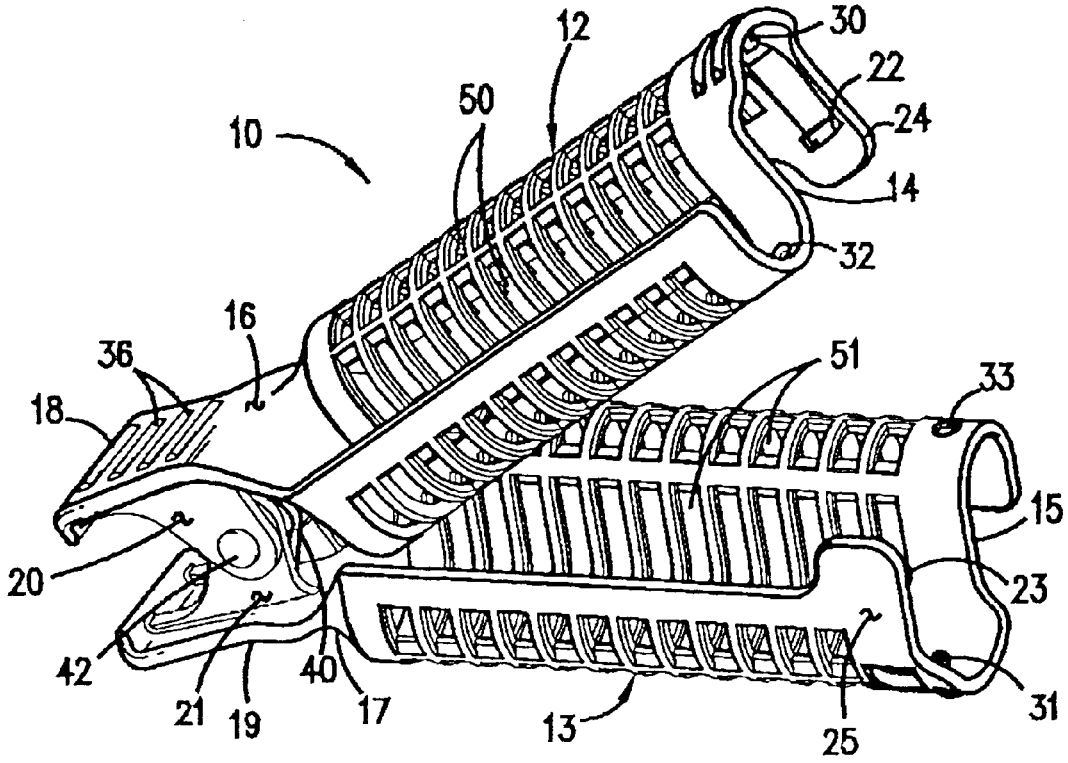
FIG. 1 is a perspective view of a preferred embodiment of a hair waving apparatus of the instant invention shown in an open position.

Looking more particularly to the drawings, there is shown in FIG. 1 a preferred embodiment of a hair waving apparatus which is generally indicated at 10, according to a preferred embodiment of the present invention.

FIG. 1 is a perspective view of a preferred embodiment of the hair waving apparatus 10 of the instant invention shown in an open position.

As seen in FIG. 1, the hair waving apparatus 10, has at least two elements 12,13 with undulations 14,15 on each elements 12,13 for producing a wave in a lock of human hair 60 as best shown in FIG. 7. The elements 12,13 have means for pivotally connecting the elements 12,13 together with a rod 42 placed between a pair of legs 20,21 which extend from an underside of a handle 18,19. Although not necessary for operation, handle 18,19 may, preferably have a grip 36,37 thereon to increase function and to facilitate handling of the hair waving apparatus 10 particularly when a user's hands are wet. The elements 12,13 are biased toward each other with a biasing means in the form of a spring 40 disposed between the legs 20,21 with the rod 42 passing therethrough the spring 40 and thereby pivotally connecting the elements 12,13. The elements 12,13 are maintained in engagement with each other by the spring 40 to hold the lock of hair 60 therebetween to impart a wave thereon. The elements 12,13 each have a shoulder 16,17 extending from the undulations 14,15 and the handle 18,19 extending therefrom the shoulder 16,17 at the pivotal connection to open the undulations 14,15 for insertion of the lock of hair 60 therebetween. The undulations 14,15 of each of the elements 12,13 are fabricated from a shape chosen from the group consisting of a "J" shape, a "U" shape, a "C" shape, an "S" shape and a "V" shape. FIG. 8, including FIG. 8A, FIG. 8B, FIG. 8C, FIG. 8D and FIG. 8E, illustrates a representation of various shapes from which the undulations 14,15 of the instant invention may be fabricated. It is understood that a wide variety of shapes suitable for wave profiles for creating a wave in a human hair 60 may be suitable for the undulations 14,15 from which the hair waving apparatus 10 may be adapted thereto during manufacture. The above group is only meant to be illustrative of such shapes and it is understood that the shapes shown are not to be limited to any one particular shape or style. The undulations 14,15 are dimensioned to allow each of the elements 12,13 to nest within each other. A plurality of vents 50,51 are disposed thereon the undulations 14,15 to allow moisture to escape from the hair 60 during hair styling and to hasten the hair drying process and subsequent wave formation in the hair 60. Additional features of the instant invention include retaining means in the form of a stop 22,23 disposed on each of the elements 12,13 for maintaining each of the elements 12,13 in engagement with each other and the stop 22,23 cooperatively interacting with the spring 40 to hold the lock of hair 60 therebetween to impart a wave thereon; and a tab 24,25 is disposed thereon each of the elements 12,13 for disengaging the elements 12,13 from each other when the elements 12,13 are biased away from each other and the hair waving apparatus 10 is in an open position. Guide means, such as a pin 29,30, are disposed on each of the elements 12,13 in alignment with a hole 32,33 therein the elements 12,13 and the pin 29,30 cooperatively interacting with the hole 32,33 and with the spring 40 for positioning the undulations 14,15 of the elements 12,13 in close proximity to each other.

Figure 2:
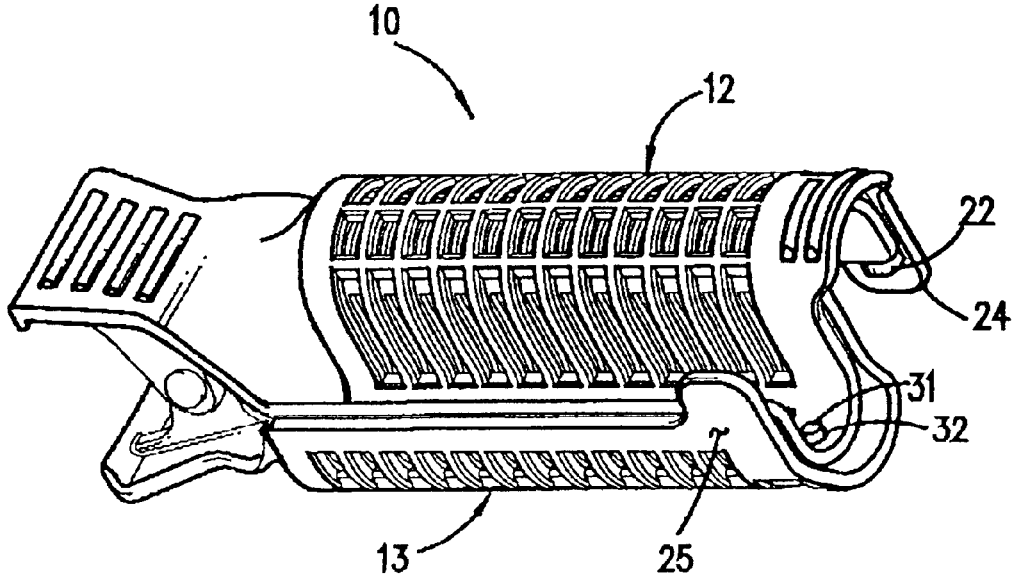
FIG. 2 is a perspective view of the hair waving apparatus of FIG. 1 shown in a closed position.

FIG. 2 is a perspective view of the hair waving apparatus 10 of FIG. 1 shown in a closed position.

Figure 3:
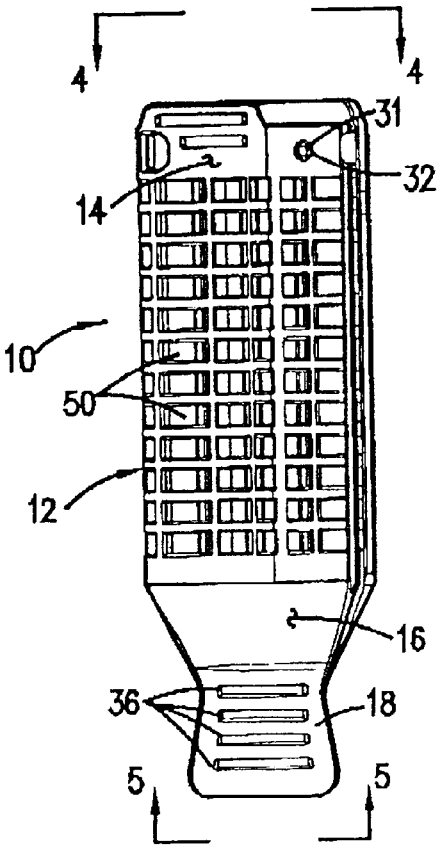
FIG. 3 is a top plan view of a preferred embodiment of the hair waving apparatus of FIG. 2 in a closed position.

FIG. 3 is a top plan view of a preferred embodiment of the hair waving apparatus 10 of FIG. 2 in a closed position.

Figure 4:
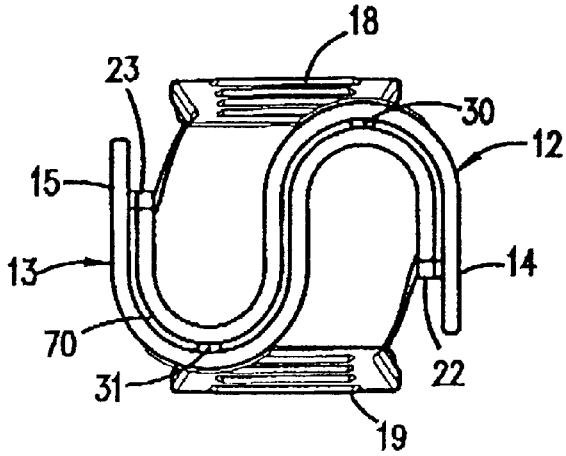
FIG. 4 is a front view of the hair waving apparatus of FIG. 3 in the direction of plane 4—4.

FIG. 4 is a front view of the hair waving apparatus 10 of FIG. 3 in the direction of plane 4—4 which shows the nesting relationship of the undulations 14,15 of the elements 12,13 and a gap 70 therebetween for receiving the lock of hair 60 therethrough as better seen in FIG. 7.

Figure 5:
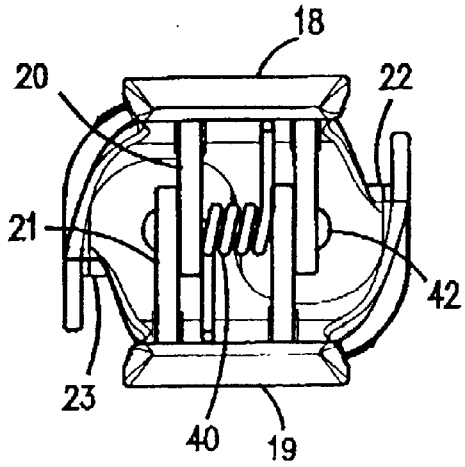
FIG. 5 is a rear view of the hair waving apparatus of FIG. 3 in the direction of plane 5—5.

FIG. 5 is a rear view of the hair waving apparatus 10 of FIG. 3 in the direction of plane 5—5 showing the spring 40, the rod 42 positioned between the legs 20,21.

Figure 6:
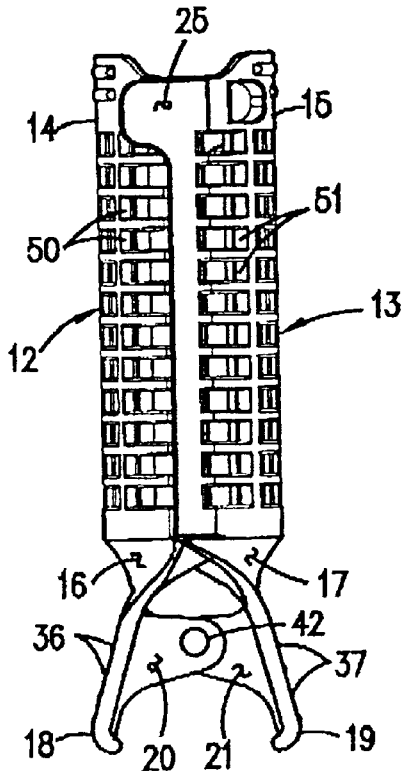
FIG. 6 is a side view of the hair waving apparatus of FIG. 3.

FIG. 6 is a side view of the hair waving apparatus 10 of FIG. 3. The grips 36,37 are clearly visible in this view as well as other design details.

FIG. 7 is a perspective view of the hair waving apparatus 10 of FIG. 2 showing the instant invention of FIG. 2 in use with a lock of human hair 60, shown in phantom.

FIG. 8 as mentioned above, including FIG. 8A, FIG. 8B, FIG. 8C, FIG. 8D and FIG. 8E, illustrates a representation of various shapes from which the undulations 14,15 of the instant invention may be fabricated.

The hair waving apparatus 10 may be fabricated from readily available materials and by conventional fabrication techniques such as by plastic molding and by metal forming. For example, hair waving apparatus 10, may be made, from a material chosen from the group consisting of nonmetals and metals. The elements 12,13 of the hair waving apparatus 10 preferably may be identically fabricated from a plastic material and the spring 40 and the rod 42 may be metal. Alternately, the elements 12,13 may be fabricated from a metal such as aluminum. The basic component parts, namely, the elements 12,13, the spring 40 and the rod 42 are readily assembled to define the hair waving apparatus 10.

To use the hair waving apparatus 10, which is in a normally closed position, the user simply squeezes the handle 18,19 allowing the elements 12,13 to open thereby being ready to receive the lock of human hair 60 placed therebetween the undulations 14,15. When the handles 18,19 are allowed to return to a normally biased closed position, the lock of human hair 60 is clamped in place and is allowed to reside therebetween the undulations 14,15 for a period of time. The vents 50,51 aid in drying the hair 60 so that, later, when the elements 12,13 are again opened, a wave is formed in the lock of human hair 60. Furthermore, for example, when the hair waving apparatus 10 is fabricated from aluminum, the aluminum when heated with a hair dryer effectively acts as a heat transfer medium which further speeds up the hair drying process. As mentioned above, FIG. 7 shows the instant invention in use with the lock of human hair 60, shown in phantom Preferably, to make the hair waving apparatus 10 work better, the stop 22,23 cooperatively interacts with the spring 40 to further maintain each of the elements 12,13 in a positive engagement with each other to hold the lock of hair 60 securely therebetween to impart a wave thereon. The tab 24,25 is used for disengaging the elements 12,13 from each other when the elements 12,13 are biased away from each other slideably bypassing the stop 22,23 when the hair waving apparatus 10 is in an open position. Also, preferably, the guide means, such as the pin 29,30 is disposed in alignment with a hole 32,33 therein the elements 12,13. The pin 29,30 cooperatively interacts with the hole 32,33 and with the spring 40 for positioning the undulations 14,15 of the elements 12,13 in close proximity to each other. The combination of the retaining means such as the stop 22,23 and the guide means, pin 29,30 and the hole 32,33, in combination with the biasing means, spring 40, cooperatively contribute to a high quality wave in the hair 60. For example, the applicant's have actually reduced the instant invention shown herein to practice. They have, according to the teachings herein constructed and have successfully tested, with favorable hair wave producing results, a fully functional prototype hair waving apparatus 10 as shown in FIGS. 1 to 7.

Surprisingly, the instant invention provides an added advantage and recognizes a problem of a need for improved wave setting and adequately and completely addresses an unfulfilled need, in that the hair waving apparatus 10, in the manner disclosed, in effect, provides a convenient apparatus which allows it to be readily adaptable in manufacture to a variety of wave forms and provides the desired above mentioned advantages and benefits to a user.

It is understood that the hair waving apparatus 10 may be constructed in a wide variety of sizes, colors and style variations. For example the hair waving apparatus 10 may be, configured in various wave forms, similar to but not limited to, the shapes of the undulations 14,15 as described above and shown in FIG. 8. Also, it is understood that, that the two elements 12,13 disclosed herein may be ganged together during fabrication to define a larger and wider hair waving apparatus 10 for use with a particular hair styling application. One practical advantage of the invention is that it provides a convenient, practical, low cost, hair waving apparatus 10, which allows a user to conveniently impart a stylish wave in the lock of human hair 60. A further advantage of the invention is that the hair waving apparatus 10 is designed for ease of manufacture by standard methods and by using readily available materials.

Of course, a wide variety of further uses and advantages of the present invention will become apparent to one skilled in the art. Also, one skilled in the art will realize that the foregoing discussion outlines the more important features of the invention to enable a better understanding of the instant invention and to instill a better appreciation of the inventors' contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed:

1. A hair waving apparatus comprising:

at least to elements;

said elements each having undulations for producing a wave in a lock of human hair;

means for pivotally connecting said elements together; and biasing means disposed between said elements to maintain said elements biased toward each other and said elements maintained in engagement with each other by said biasing means to hold the lock of hair therebetween to impart a wave thereon;

said elements each have a shoulder extending from said undulations and a handle extending therefrom said shoulder at the pivotal connection to open said undulations for insertion of the lock of hair therebetween;

said undulations of each said elements dimensioned to allow each said elements to nest;

said pivotally connecting means comprises a rod;

said biasing means is a spring;

guide means disposed on each said elements cooperatively interacting with said biasing means for positioning said undulations of said elements in close proximity to each other;

said guide means comprises a pin which is aligned with each said elements having a hole therein.

2. The apparatus of claim 1 further comprising retaining means disposed on each said elements for maintaining each said elements in engagement with each other and said retaining means cooperatively interacting with said biasing means.

3. The hair waving apparatus of claim 2 wherein said retaining means is a stop.

4. The hair waving apparatus of claim 3 wherein each said elements have a tab for permitting said elements to be disengaged from each other bypassing said stop when said elements are biased away from each other and said hair waving apparatus is in an open position.

5. The device of claim 4 wherein said undulations have a plurality of vents disposed thereon to allow moisture to escape from the hair during hair styling and to hasten the hair drying process and subsequent wave formation in the hair.

6. The apparatus of claim 5 wherein said hair waving apparatus is fabricated from a material chosen from the group consisting of nonmetals and metals.

7. The apparatus of claim 6 wherein said undulations are fabricated from a shape chosen from the group consisting of a "J" shape, a "U" shape, a "C" shape, an "S" shape and a "V" shape.

8. A hair waving apparatus comprising:

at least two elements, said elements each having undulations for producing a wave in a lock of human hair;

said undulations of each said elements dimensioned to allow each said elements to nest;

means for pivotally connecting said elements together;

biasing means disposed between said elements to maintain said elements biased toward each other;

said elements each having a shoulder extending from said undulations and a handle extending therefrom said shoulder at the pivotal connection to open said undulations for insertion of the lock of hair therebetween, retaining means disposed on each said elements for maintaining each said elements in engagement with each other and said retaining means cooperatively interacting with said biasing means to hold the lock of hair therebetween to impart a wave thereon; and a tab disposed thereon each said elements for disengaging said elements from each other when said elements are biased away from each other and said hair waving apparatus is in an open position.

9. The hair waving apparatus of claim 8 wherein said retaining means is a stop.

10. The apparatus of claim 9 wherein said undulations are fabricated from a shape chosen from the group consisting of a "J" shape, a "U" shape, a "C" shape, an "S" shape and a "V" shape.

11. The device of claim 10 wherein said undulations have a plurality of vents disposed thereon to allow moisture to escape from the hair during hair styling and to hasten the hair drying process and subsequent wave formation in the hair.

12. A hair waving apparatus comprising:

at least two elements;

said elements each having undulations for producing a wave in a lock of human hair;

each said elements being identical and disposed in a facing relationship with respect to each other and said undulations dimensioned to allow each said elements to nest;

said undulations having a plurality of vents disposed thereon to allow moisture to escape from the hair during hair styling and to hasten the hair drying process and subsequent wave formation in the hair;

a rod pivotally connecting said elements together;

a spring disposed between said elements to maintain said elements biased toward each other;

a shoulder extending from said undulations;

a handle extending therefrom said shoulder at the pivotal connection to open said undulations for insertion of the lock of hair therebetween;

a pin disposed on each said elements in alignment with each said elements having a hole therein and said pin cooperatively interacting with the hole and with said spring for positioning said undulations of said elements in close proximity to each other;

a stop disposed on each said elements for maintaining each said elements in engagement with each other and said stop cooperatively interacting with said spring to hold the lock of hair therebetween to impart a wave thereon; and a tab disposed thereon each said elements for disengaging said elements from each other thereby bypassing said stop when said elements are biased away from each other and said hair waving apparatus is in an open position.

13. The apparatus of claim 12 wherein said undulations are a "J" shape.

14. The apparatus of claim 12 wherein said undulations are a "U" shape.

15. The apparatus of claim 12 wherein said undulations are a "C" shape.

16. The apparatus of claim 12 wherein said undulations are an "S" shape.

17. The apparatus of claim 12 wherein said undulations are a "V" shape.

* * * * *